United States Patent [19]

Ewald et al.

[11] 4,017,009

[45] Apr. 12, 1977

[54] CHILD SAFETY CLOSURE (METHOD III)

[75] Inventors: Robert F. Ewald, Rolling Meadows, Ill.; Norbert Normos, Courbevoie, France

[73] Assignee: Seaquist Valve Company, Div. of Pittway Corporation, Cary, Ill.

[22] Filed: June 10, 1974

[21] Appl. No.: 477,969

Related U.S. Application Data

[63] Continuation-in-part of Ser. No. 352,440, April 19, 1973, Pat. No. 3,885,717.

[52] U.S. Cl. ..... 222/402.11

[51] Int. Cl.[2] ..... B65D 83/14

[58] Field of Search ..... 222/182, 402.13, 402.15, 222/402.11; 206/42; 194/54; 215/9; 292/DIG. 65

[56] References Cited

UNITED STATES PATENTS

| | | | |
|---|---|---|---|
| 2,936,189 | 5/1960 | Pearson | 292/DIG. 65 |
| 3,554,366 | 1/1971 | Corll | 222/182 X |
| 3,608,785 | 9/1971 | Durso et al. | 222/402.13 |
| 3,651,993 | 3/1972 | Venus | 222/402.11 X |
| 3,666,338 | 5/1972 | Russell | 292/DIG. 65 |
| 3,698,543 | 10/1972 | Trotta | 222/182 X |
| 3,698,604 | 10/1972 | Nigro | 222/182 |
| 3,712,515 | 1/1973 | Corll | 222/182 |
| 3,786,968 | 1/1974 | Ewald | 222/402.11 |

*Primary Examiner*—Stanley H. Tollberg
*Assistant Examiner*—Phil Stack, Jr.

[57] ABSTRACT

A childproof safety adaptor for an aerosol dispenser comprising an adaptor having at least one pair of resilient spaced finger guides formed thereon, each finger guide includes a locking ledge arranged to operatively engage the button actuator to prevent actuation of the dispenser when in the "locked" position. The spaced separation of the finger guides is such that a finger inserted therebetween moves the finger guides outwardly relative to each other, moving the locking ledges out of operative engagement with the button actuator thereby permitting vertical movement of the button actuator for actuation and wherein upon removal of the finger from between the finger guides, the locking ledges automatically return to the "locked" position.

5 Claims, 34 Drawing Figures

FIG. 1
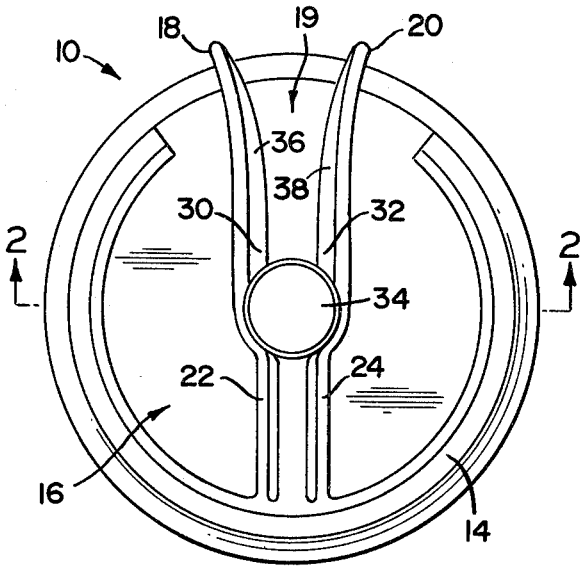
FIG. 3
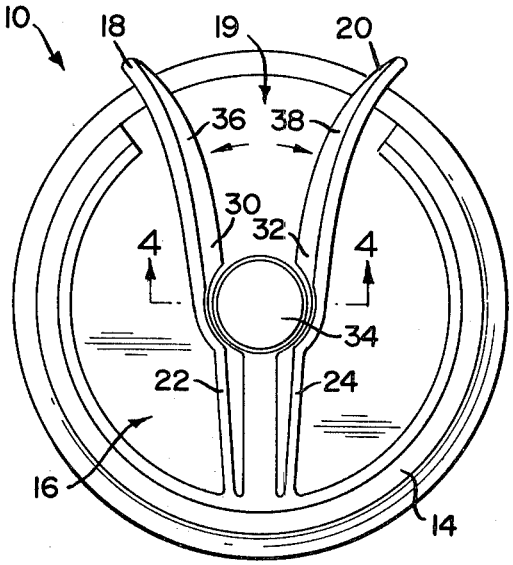
FIG. 2
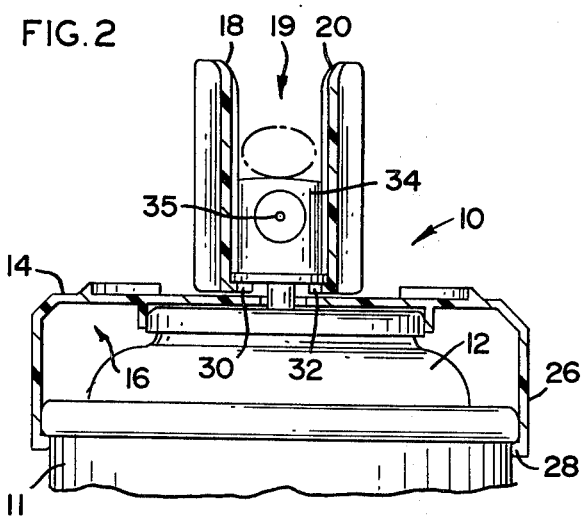
FIG. 4
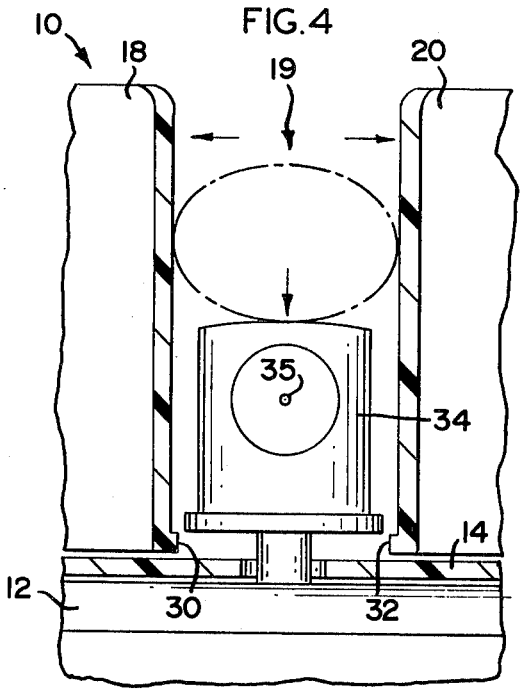
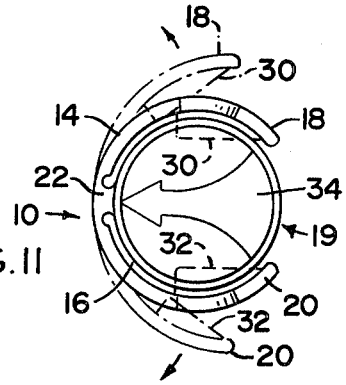
FIG. 11
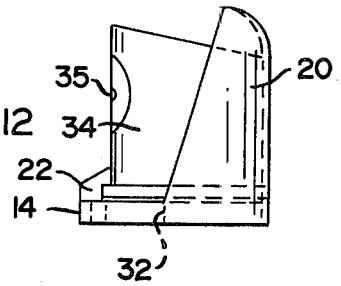
FIG. 12

FIG. 13
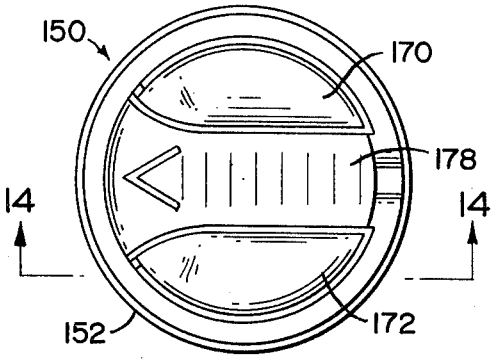
FIG. 16
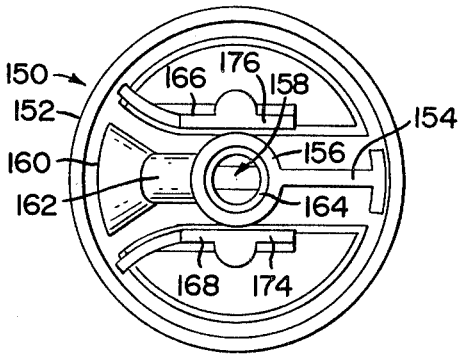
FIG. 14
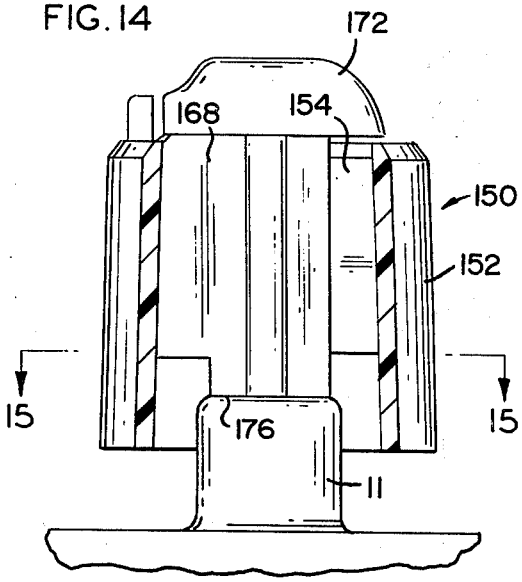
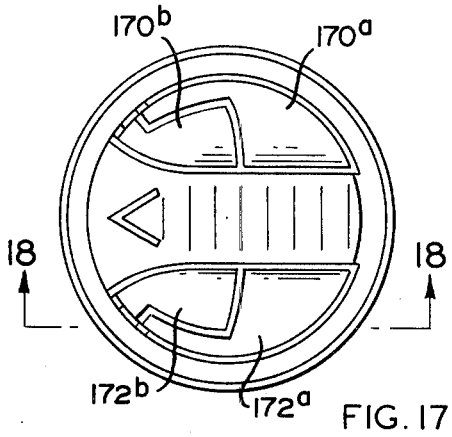
FIG. 17
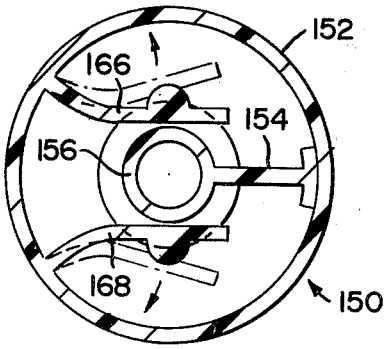
FIG. 15
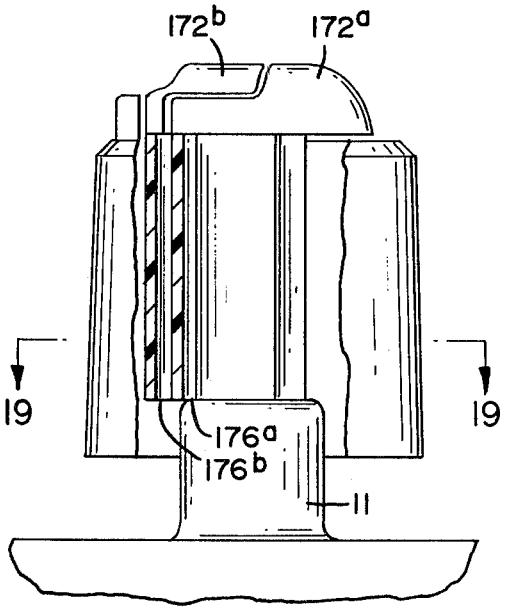
FIG. 18

FIG. 19
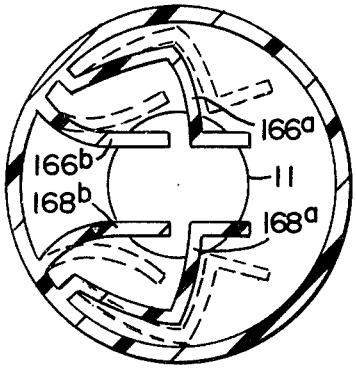
FIG. 22
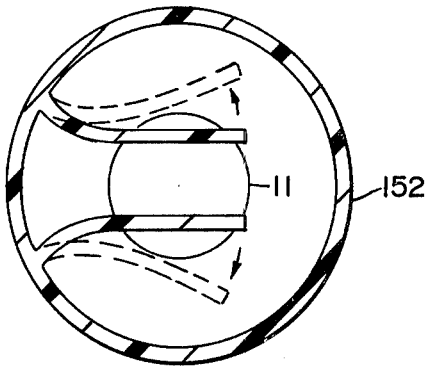
FIG. 20
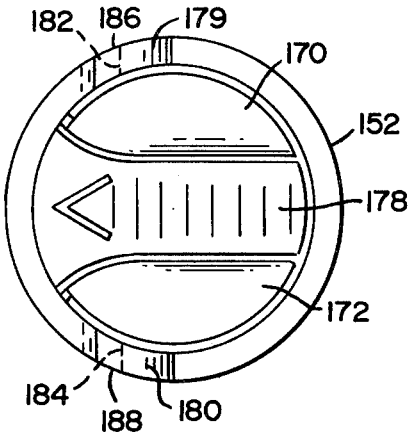
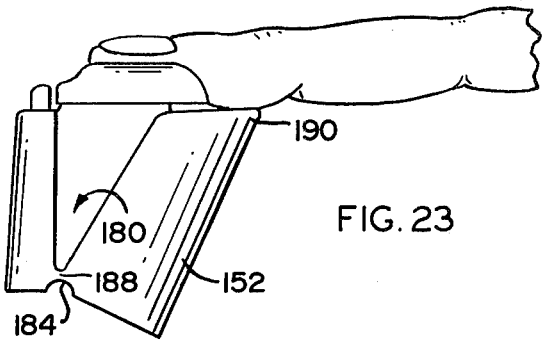
FIG. 23
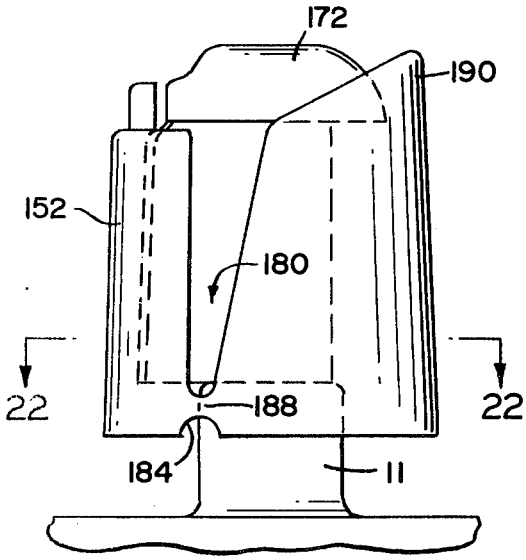
FIG. 21
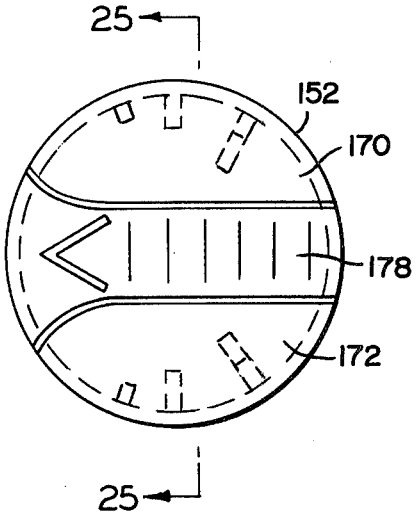
FIG. 24

FIG. 31
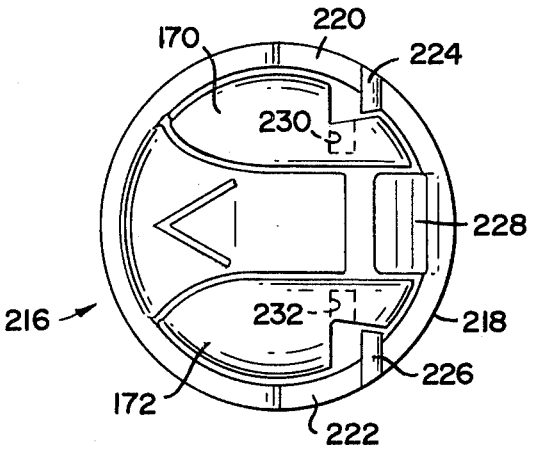
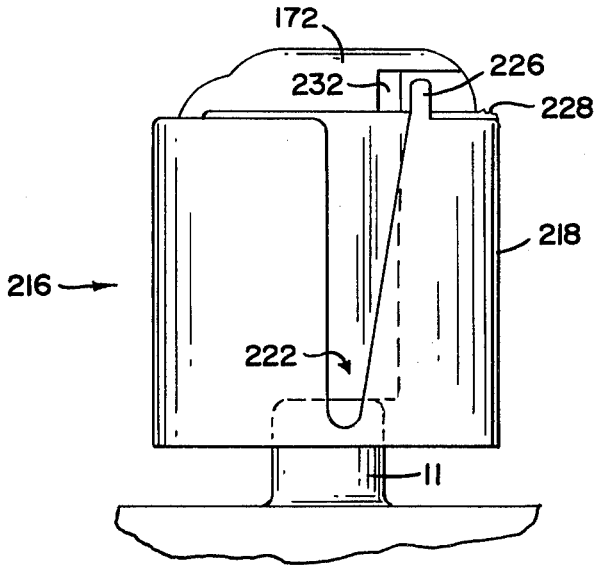
FIG. 32

FIG. 33
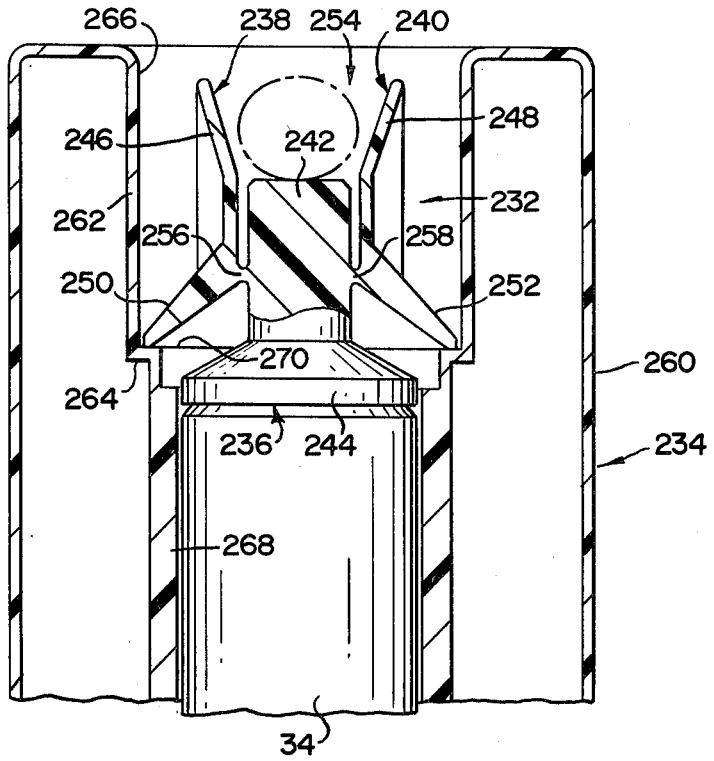
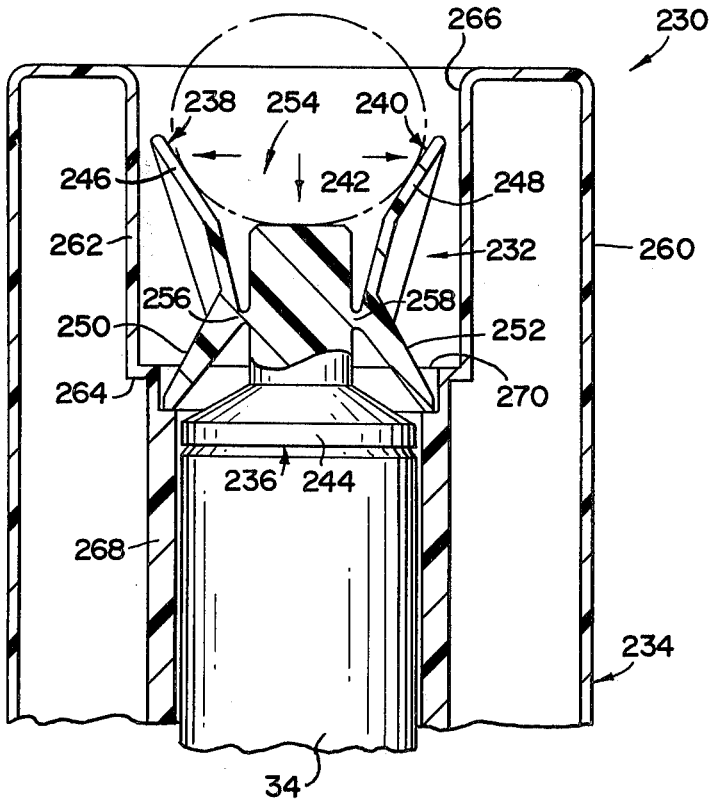
FIG. 34

CHILD SAFETY CLOSURE (METHOD III)

This is a continuation-in-part application of Ser. No. 352,440 filed Apr. 19, 1973 now U.S. Pat. No. 3,885,717.

BACKGROUND OF THE INVENTION

1. Field of the Invention

This invention relates to a childproof safety adaptor for an aerosol dispenser comprising an adaptor including at least one pair of locking ledges which cooperatively engage the button actuator to prevent actuation of the dispenser when the adaptor is in the "locked" position.

2. Description of the Prior Art

Since the introduction of aerosol dispensers, there has been a continuing problem of inadvertent actuation of the dispensers. Unless some means to prevent accidental discharge of the aerosol during transportation and storage is provided, the consumer is not assured of purchasing a fully charged aerosol.

Another, more serious problem is that of young children discharging the aerosol contents. This is particularly critical when the product is a cleaning agent, insecticide or other potentially hazardous matter commonly found in the home.

Numerous attempts have been made to provide tamperproof and childproof dispensers. The earliest and simplest of these is the cup-like overcap configured to detachably attach over the mounting cup and buttom actuator of the dispenser. Unfortunately, the simplicity of operation allows young children to remove the protective overcap from the dispenser with little effort. In addition, the separate overcap may inadvertently be left off the dispenser thereby removing the safety feature.

One of the principal obstacles in developing an effective childproof dispenser has been to design a dispenser which is reasonably simple for an adult to use and still be beyond the capabilities of young children. Most of the more effective designs comprise mechanisms which require a definite sequence of positioning the dispenser in the locked or unlocked configuration. The dispenser must be relocked by repositioning the locking mechanism. As a result, the childproofing feature is subject to being inadvertently defeated by failure to relock the device. Unfortunately, many existing tamperproof dispensers include elaborate locking mechanisms which are complex in structure and prohibitively expensive to manufacture. In addition, these mechanism usually require changes or redesign of the basic dispenser and valve assembly structure thereby increasing production costs.

Thus, while numerous attempts have been made to assign and manufacture an inexpensive, effective tamperproof/childproof aerosol dispenser, substantial room for development and improvement remains.

SUMMARY OF THE INVENTION

This invention relates to a child safety adaptor for an aerosol or like fluid dispenser including means to prevent actuation of the dispenser by a finger of a predetermined dimension. While the safety adaptor structure of the present invention is hereinafter described primarily with reference to an aerosol type dispenser, it should be noted that the inventive structure of the adaptor can be utilized in combination with other types of fluid dispensers and accompanying valve mechanisms, such as finger pumps or the like. Similarly, reference to button or button actuator is hereinafter meant to include any actuator type structure capable of being adapted to a finger type pump or finger type valve mechanism wherein the structure is manually operated to accomplish dispensing. More specifically, the present invention comprises an adaptor having at least one pair of spaced finger guides, each finger guide including a locking ledge.

The adaptor comprises a circular base having an annular skirt depending therefrom. The lower portion of the skirt includes an inwardly projecting annular lip that engages the outer circumference of the mounting cup to secure the safety adaptor to the dispenser. The finger guides are held in spaced relation relative to each other by a pair of resilient spring arms attached to the annular base. The locking ledges formed on the finger guides normally engage the button actuator to prevent actuation of the dispenser. Of course, a plurality of finger guide pairs may be used as an addtional safety precaution.

In an alternate embodiment, a button depressor is added. The button depressor comprises a substantially cylindrical body including a centrally disposed button actuator recess formed therein to receive a button actuator attached to the valve stem. In this configuration, the locking ledges engage the button depressor rather than the button actuator.

In a second alternate embodiment, the adaptor may be attached to or integrally formed on the button actuator. In this configuration, the finger guides may be disposed either above or below the button actuator. As with the first embodiment, a plurality of pairs of finger guides may be employed as an additional safety precaution.

Still another alternate embodiment may include a second locking means which normally engages the finger guides to prevent relative movement therebetween when in the locked position.

As previously described, the locking ledges are biased in the normally "locked" position, the locking ledges operatively engage the button actuator to prevent vertical movement or actuation of the dispenser.

In still another alternate embodiment, the adaptor comprises a button depressor including a pair of locking elements thereon and an overcap including a locking ledge formed thereon to normally engage the locking elements in the "locked" position. In this embodiment, each locking element may comprise a single member or a plurality of members comprising a plurality of pairs arranged in parallel relationship relative to each other.

To actuate the dispenser, the operator inserts a finger between the finger guides toward the button actuator. The space between the finger guide is such that when an adult finger is inserted therebetween, the finger impinges against the sides of the finger guides expanding the guides outward relative to each other. As a result, the locking ledges are moved out of cooperative engagement with the button actuator to permit actuation because the button actuator is clear to pass inside the locking ledges. When a plurality of pairs of finger guides is employed, the finger must be inserted through each pair of finger guides to "unlock" the safety adaptor.

To deactuate, the finger is withdrawn allowing the finger guides and locking ledges to move inwardly toward the normally "locked" position. With the finger removed, the biasing spring in the valve forces the button actuator upward until the locking ledges again operatively engage the button actuator. The system is thus automatically locked until reactuated. The space between the finger guides is such that a small finger such as a child's finger is not wide enough to move the locking ledges out of operative engagement with the button actuator.

Operation of the dispenser, including the second locking means is similar except the second locking means is initially moved out of operative engagement with the finger guides to permit separation therebetween as previously described.

Actuation of the alternative embodiment having a button depressor is similar in operation. By inserting a finger between the finger guides, the locking ledges are moved out of operative engagement with the button depressor, allowing the depressor to engage the button actuator and actuate the dispenser. Deactivation is similar to the basic embodiment except that as the operator's finger is withdrawn, the locking ledges engage the button depressor to hold it out of operative engagement from the button actuator.

With the safety adaptor attached to the button actuator as in the second alternate embodiment, the finger guides and locking ledges are moved into and out of the "locked" and "unlocked" portion as previously described in the other embodiments.

The safety adaptor comprising the button depressor and overcap operates in substantially the same manner as the button depressor adaptor previously described. Of course, with the plurality of pairs, each pair must be "unlocked" to actuate the safety adaptor.

Although as described, the adaptor is attached to the mounting cup or button actuator. It should be understood that the adaptor may be attached to the dispenser can itself.

This invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention reference should be had to the following detailed description taken in connection with the accompanying drawings in which:

FIG. 1 is a top view of the safety adaptor in the "locked" position.

FIG. 2 is a cross-sectional side view of the safety adaptor mounted on an aerosol dispenser taken along line 2—2 of FIG. 1.

FIG. 3 is a top view of the safety adaptor in the "actuated" position.

FIG. 4 is a detailed cross-sectional front view of the safety adaptor taken along line 4—4 of FIG. 3.

FIG. 11 is a top view of another alternate embodiment.

FIG. 12 is a side view of the alternate embodiment of FIG. 11.

FIG. 13 is a top view of still another alternate embodiment.

FIG. 14 is a cross-sectional side view of the safety adaptor taken along line 14—14 of FIG. 13.

FIG. 15 is a cross-sectional top view taken along line 15—15 of FIG. 14.

FIG. 16 is a bottom view of the alternate embodiment of FIG. 13.

FIG. 17 is still another alternate embodiment of the safety adaptor.

FIG. 18 is a cross-sectional side view taken along line 18—18 of FIG. 17.

FIG. 19 is a cross-sectional view taken along line 19—19 of FIG. 18.

FIG. 20 is a top view of another alternate embodiment of the safety adaptor.

FIG. 21 is a side view of the alternate embodiment of FIG. 20 in the "locked" position.

FIG. 22 is a cross-sectional top view taken along line 22—22 of FIG. 21.

FIG. 23 is a side view of the alternate embodiment of FIG. 20 in the "unlocked" position.

FIG. 24 is a top view of another alternate embodiment of the safety adaptor.

FIG. 31 is a top view of still another alternate embodiment of the safety adaptor.

FIG. 32 is a side view of the alternate embodiment shown in FIG. 31.

FIG. 33 is a cross-sectional front view of an alternate embodiment of the safety adaptor in the "locked" position.

FIG. 34 is a cross-sectional front view of the embodiment of FIG. 33 in the "actuated" position.

Similar reference characters refer to similar parts throughout the several views of the drawings.

DETAILED DESCRIPTION OF THE PREFERRED EMBODIMENT

Figure 5:
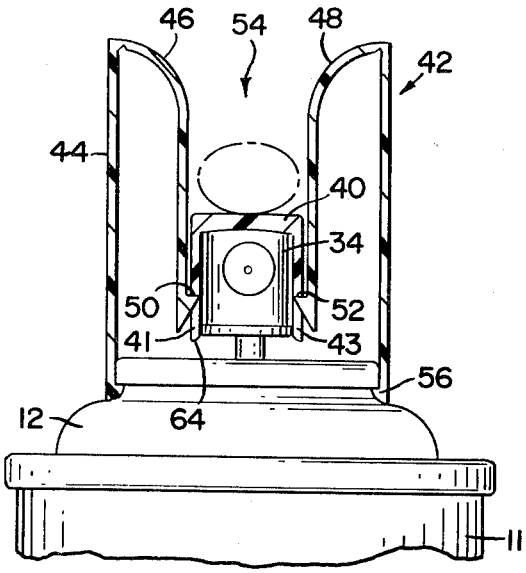
FIG. 5 is a cross-sectional front view of an alternate embodiment of the safety adaptor in the "locked" position.

The invention, as shown in FIGS. 1 through 4, comprises a childproof safety adaptor 10 including a pair of finger guides 18 and 20 and locking ledges 30 and 32 attached to a mounting cup 12.

The adaptor 10 comprises a horizontally disposed circular base 14 including aperture 16 and a pair of finger guides 18 and 20 attached thereto by a pair of resilient spring arms 22 and 24 respectively which extend rearwardly from the base 14. Finger guides 18 and 20 cooperatively form a finger passage 19 therebetween. An annular skirt 26 depends from the outer periphery of the base 14. An inwardly projecting annular lip 28 is formed on the lower portion of skirt 26 to attach the adaptor 10 to the aerosol container 11. The finger guides 18 and 20 include locking ledges 30 and 32 respectively which are normally biased beneath the button actuator 34 (FIG. 1) to normally prevent vertical movement thereof. As best shown in FIGS. 1 and 3, the inside surfaces 36 and 38 guide fingers 18 and 20 may be contoured inwardly for ease of actuation.

Alternately, the childproof safety adaptor 150 may comprise a hollow cylindrical base 152 as shown in FIGS. 13 through 16. As shown in FIG. 16, a vertically disposed rib member 154 extends across the diameter of base 152. Formed at the mid-point of rib member 154 is a cylindrical body 156 having discharge passage 158 formed therein. Formed in the sidewall of base 152 is discharge orifice 160 in communication with discharge passage 158 through terminal discharge passage 162. The cylindrical body 156 includes a stepped portion 164 to engage the top portion of the valve assembly. A pair of vertically disposed resilient spring arms 166 and 168 extend inwardly from the side wall of base 152. A pair of finger guides 170 and 172 are formed on the upper portions of spring arms 166 and 168 respectively. The lower edges of spring arms 166 and 168 comprise locking ledges 174 and 176 respectively, as more fully described hereinafter. Finger guides 170 and 172 extend to either side of finger rest 178.

FIGS. 17 through 19 show an alternate embodiment of FIGS. 13 through 16 comprising a plurality of finger guide pairs 170*a*/172*a* and 170*b*/172*b* with corresponding spring arms 166*a*/168*a* and 166*b*/168*b*, and locking ledges 174*a*/176*a*. This embodiment operates similar to FIGS. 13 through 16 as more fully described hereinafter.

FIGS. 20 through 23 show still another alternate embodiment. The structure is similar to that shown in FIGS. 13 through 16 with the addition of a second locking means. The second locking means comprises a pair of grooves 179 and 180 formed on opposite sides of the base 152 with corresponding notches 182 and 184 respectively formed in the lower periphery of the sidewall of the base 152. Grooves 179/180 and notches 182/184 cooperatively form spring members 186/188 respectively. Extending upward from the rear portion of the base 152 is a locking member 190 which normally extends past the finger guides 170/172 to limit the outward separation of the finger guides 170/172 relative to each other when in the "locked" position as more fully described hereinafter.

Figure 25:
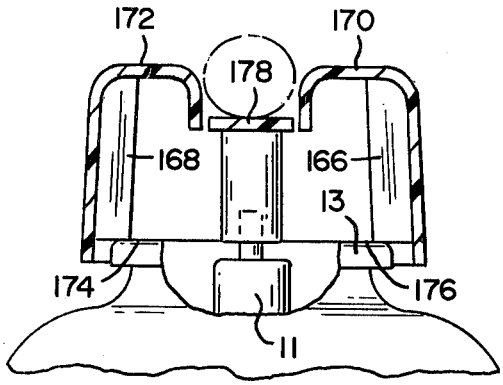
FIG. 25 is a cross-sectional view taken along line 25—25 of FIG. 24.
Figure 28:
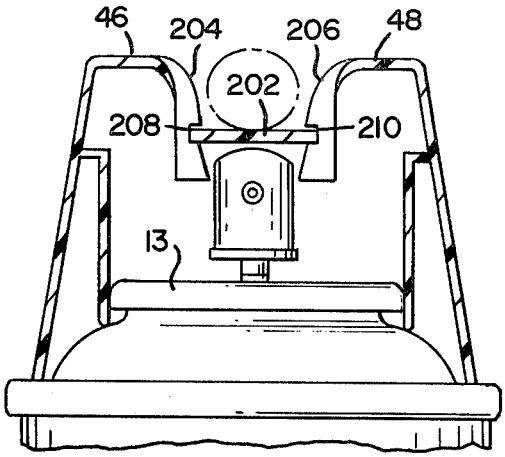
FIG. 28 is a cross-sectional front view taken along line 28—28 of FIG. 27.
Figure 26:
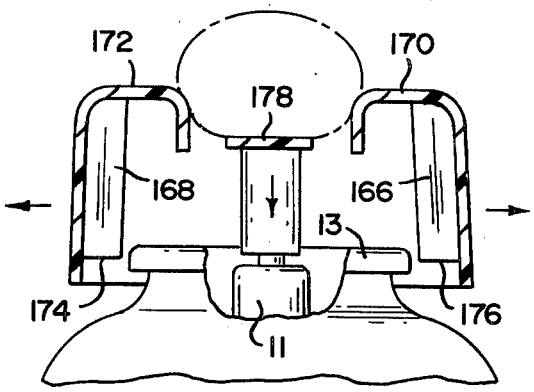
FIG. 26 is a cross-sectional view similar to FIG. 25 of the safety adaptor in the "actuated" position.

Still another alternate embodiment of FIGS. 13 through 16 is shown in FIGS. 24 through 26. Instead of the locking ledges 174/176 normally engaging the turret 11, the resilient spring arms 168/168 extend over the rim or edge of the mounting cup 13 such that the locking ledges 174/176 operatively engage the rim of the mounting cup 13 when in the "locked" position as more fully described hereinafter.

Figure 6:
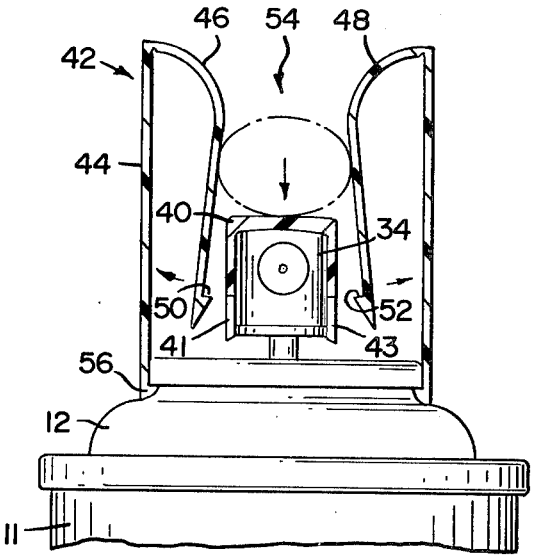
FIG. 6 is a cross-sectional front view of the alternate embodiment of the safety adaptor in the "actuated" position.

FIGS. 5 and 6 show an alternate embodiment including a button depressor 40 including notches 41 and 43 formed in the periphery thereof. In this embodiment, the adaptor 42 comprises a substantially cylindrical interconnecting means 44 and a pair of substantially vertical finger guides 46 and 48 attached to the upper portion thereof. A pair of substantially horizontal locking ledges 50 and 52, formed on the lower portion of finger guides 46 and 48 respectively, are normally biased (FIG. 4) in operative engagement with notches 41 and 43. The finger guides 46 and 48 cooperatively form finger passage 54 therebetween. The adaptor 42 is snap fitted to the mounting cup 12 by inwardly projecting annular lip 56. As shown in FIG. 5, the operative engagement of notches 41 and 42 with locking ledges 50 and 52 prevents the operative engagement of button depressor 40 and button actuator 34.

Figure 7:
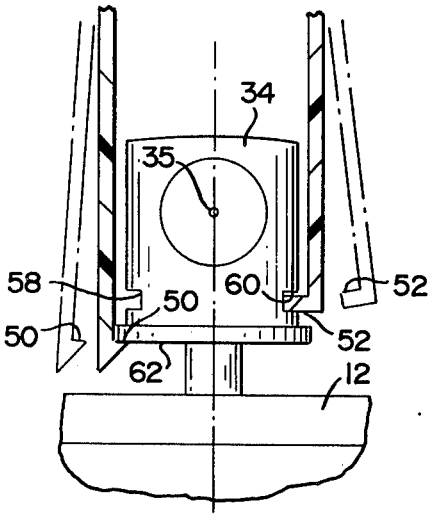
FIG. 7 is a cross-sectional front view of another alternate embodiment of the safety adaptor in the "locked" position.

FIG. 7 shows an adaptor of FIGS. 5 and 6 without the button depressor 40. In this embodiment, locking ledges 50 and 52 may engage notches 58 and 60 respectively formed in the sides of button actuator 34 (right side of FIG. 7) to prevent vertical movement of the button actuator 34 when in the "locked" position or simply engage the bottom surface of either actuator or depressor indicated or 62 and 64 respectively (left side of FIG. 7).

Figure 29:
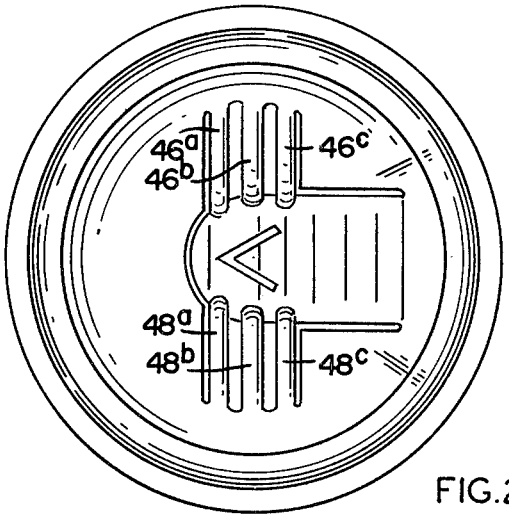
FIG. 29 is a top view of the alternate embodiment of FIG. 27.
Figure 27:
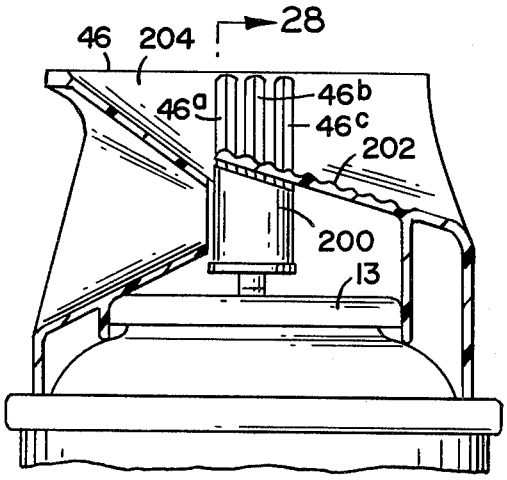
FIG. 27 is a cross-sectional side view of another alternate embodiment.
Figure 30:
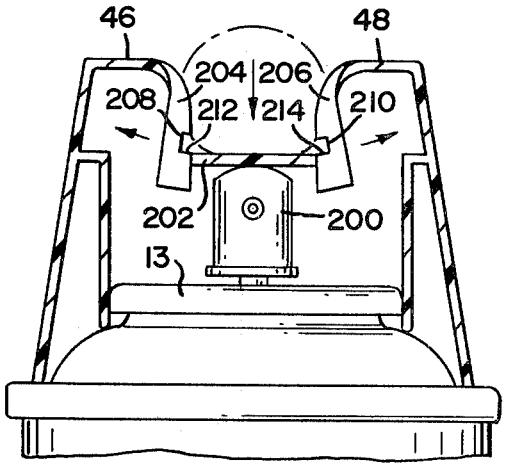
FIG. 30 is a cross-sectional front view taken along line 30—30 of FIG. 29 of the safety actuator in the "actuated" position.

FIGS. 27 and 30 show an alternate embodiment of the structure in FIG. 7 including a button actuator having an enlarged locking member 202 formed about the periphery thereof. The finger guides 46 and 48 comprise a pair of vertically disposed members including tab members 204/206 and notch members 208/210 respectively. The lower edge of the notch members 208/210 form locking ledges 212/214 respectively. The adaptor may include a plurality of pairs of finger guides 46*a*–*c*148*a*–*c* as best shown in FIG. 29 or a single pair of finger guides 46/48.

Figure 8:
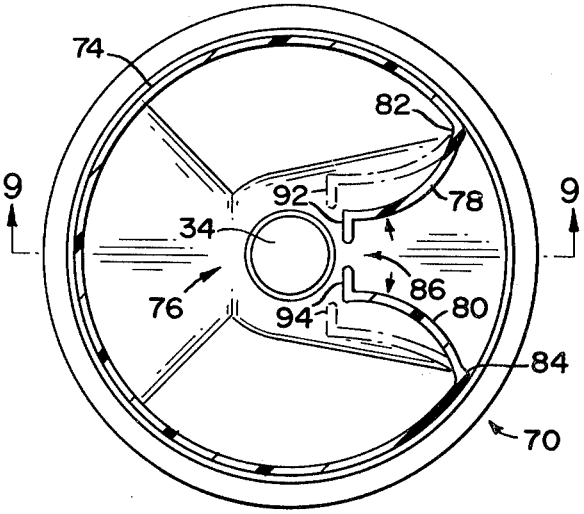
FIG. 8 is a cross-sectional top view of still another alternate embodiment of the safety adaptor.
Figure 9:
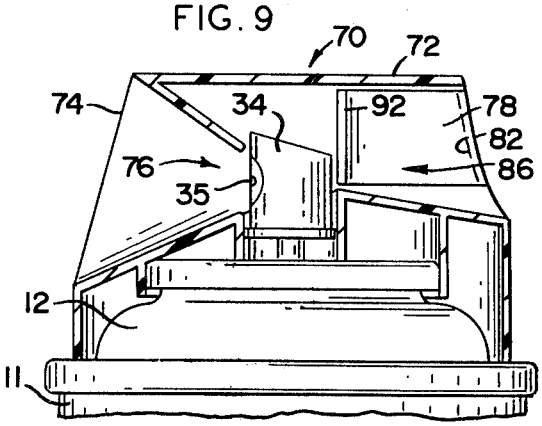
FIG. 9 is a cross-sectional side view of the safety adaptor of FIG. 8.

FIGS. 8 and 9 show still another alternate embodiment of the present invention. As best shown in FIG. 8, the mounting cup adaptor 70 comprises a cup-shaped overcap 72 including a substantially vertical annular side wall 74 having a spray passage 76 formed in the side thereof opposite the spray orifice 35 of button actuator 34. A pair of vertically disposed finger guides 78 and 80 are attached to the rear portion of the sidewall 74 by resilient spring arms 82 and 84 respectively. The finger guides 78 and 80 cooperatively form finger passage 86. In addition, a pair of actuator guards 92 and 94 are formed on finger guides 78 and 80 respectively.

Figure 10:
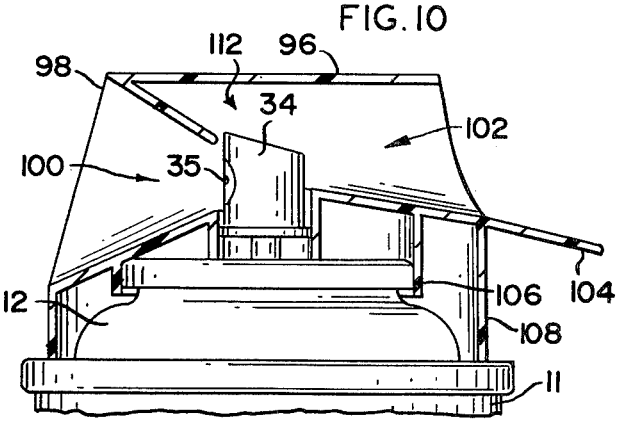
FIG. 10 is a cross-sectional top view of still another alternate embodiment of the safety adaptor.

FIG. 10 shows the adaptor as a cup-shaped overcap 96 including a substantially vertical annular side wall 98 having a spray passage 100 formed in the side thereof opposite the spray orifice 35 of button actuator 34. Finger passsage 102 is formed in the side wall 98 above and adjacent to lip extension 104. When mounted on a dispenser by the annular rings 106 and 108, the button actuator extends upwardly through aperture 110 into recess 112.

FIGS. 11 and 12 show another embodiment wherein the adaptor is attached or integrally formed on the button actuator 34. As shown in FIGS. 11 and 12, the adaptor 10 comprises an annular base 14 including aperture 16 and a pair of finger guides 18 and 20 extending upwardly therefrom. The adaptor is attached to the button actuator 34 by a resilient spring arm 22 rearwardly from the forward portion of the base 14. Finger guides 18 and 20 cooperatively form a finger passage 19 therebetween. The finger guides 18 and 20 include locking ledges 30 and 32 respectively which are normally biased beneath the button actuator 34 (FIG. 11) to prevent vertical movement of the button actuator 34. As best shown in FIG. 11, the inside surfaces 36 and 38 of guide fingers 18 and 20 may be contoured inwardly to facilitate actuation.

FIGS. 31 and 32 show another alternate embodiment including a second locking means. The adaptor 216 comprises a cylindrical base 218 similar to that of FIGS. 20 through 23. Formed in the opposite sides of the base 218 are grooves 220 and 222. Immediately rearward of grooves 220 and 222 are locking lugs 224 and 226 respectively extending upward from the periphery of the base 218. A finger depressor 228 disposed between the lugs 224/226 is formed on the base 218. Formed on the rear portion of finger guides 170/172 are alignment slots 230/232 respectively corresponding to the locking lugs 224/226. As shown, the locking lugs 224/226 normally engage the sides of finger guides 170/172 respectively to prevent separation thereof as more fully described hereinafter.

FIGS. 33 and 34 show still another embodiment of the safety adaptor generally indicated as 230. As shown therein, the safety adaptor 230 comprises a valve mechanism depressor 232 and an overcap 234. The valve mechanism depressor 232 comprises a base generally indicated as 236 disposed and configured to engage and force an actuator button or like valve mechanism into operating position. Finger guides 238 and 240 are movably connected to the base 236 which may be considered part of the valve actuator 34. Base 236 includes an upper body portion 242 and an enlarged lower portion 244. The finger guides 238 and 240 comprise upper actuator elements 246 and 248 respectively and lower locking elements 250 and 252 respectively. The upper actuator elements 246 and 248 are disposed relative to each other to cooperatively form a finger passage 254 therebetween. The finger guides 238 and 240 serves as control means in that they are disposed relative to one another to prevent actuation by a finger less than a predetermined dimension. The finger guides are interconnected to base 236 by resilient interconnecting means or arms 256 and 258 respectively. The overcap 234 may be considered part of the fluid dispenser and includes a substantially cylindrical outer wall 260 and a substantailly cylindrical inner skirt 262 interconnected thereto by a substantially horizontal annular member 264. The inner skirt includes an upper inner wall 266 and a lower inner wall 268. The lower inner wall 268 is of reduced diameter relative to the upper inner wall 266 to cooperatively form a substantially annular, horizontally disposed locking ledge 270.

As shown in FIGS. 33 and 34, the button depressor 232 is disposed to engage the button actuator 34 to actuate the aerosol dispenser as more fully described hereinafter. As shown in FIG. 33, the lower locking elements 250 and 252 are disposed to normally engage the locking ledge 270 to "lock" the dispenser against actuation. As shown in FIG. 34, when in the "actuated" position, the finger guides 238 and 240 rotate relative to the body 242 to permit vertical movement of the button depressor 232.

As shown in FIGS. 4, to actuate the dispenser, the operator inserts a finger into the finger passage 19 toward the button actuator 34. The spaced separation of the finger guides 18 and 20 is such that an adult will force the guides 18 and 20 outwardly relative to each other moving the lock ledges 30 and 32 out of operative engagement with the buttom actuator 34 thereby permitting vertical movement of the button actuator 34 to dispense product from the dispenser.

To actuate, the finger is withdrawn from the finger passage 19 allowing the finger guides 18 and 20 and locking ledges 30 and 32 to move inwardly toward the normally "locked" position. With the finger removed, the biasing spring of the valve (not shown) forces the button actuator 34 upward until the locking ledges 30 and 32 again operatively engage the button actuator 34. The system is thus automatically locked until reactuated. The space between the finger guides 18 and 20 is such that a small child's finger is not wide enough to move the locking ledges 30 and 32 out of operative engagement with the button actuator 34.

To actuate the dispenser of the embodiment shown in FIGS. 13 through 16, the operator inserts a finger between finger guides 170/172 forcing the guides outward relative to each other moving the locking ledges 174/176 out of operative engagement with the top of turret 11 thereby permitting vertical movement of the adaptor 150 under the downward pressure of the finger depressing on top of finger rest 178 to dispense product from the dispenser.

To deactuate, the finger is simply withdrawn from between finger guides 170/172 allowing the resilient interconnecting spring arms 166/168 to move inwardly relative to the turret 11 towards the normally "locked" position. With the finger removed, the biasing spring of the valve (not shown) forces the adaptor 150 upward until the locking ledges 174/176 again operatively engage the top of turret 11. Thus, the system is automatically "locked" until reactuated. The alternate embodiment of FIGS. 17 through 19 operates identically to that of the structure shown in FIG. 13 thoroughly except that the finger must be inserted between the plurality of pairs of finger guides 170/172 in order to move the corresponding locking ledges 174/176 out of operative engagement with the top of turret 11. Upon removal of the finger from between the finger guides 170/172, the locking lodges will automatically "lock" the systems until reactuated.

As previously discussed, the embodiment of FIGS. 20 through 23 includes a second locking means comprising locking member 190 disposed relative to finger guides 170/172 such that relative movement therebetween is normally prevented. Grooves 178/180 and notches 182/184 permit rotation of the rear portion of base 152 downward moving locking member 190 out of operative engagement with the finger guides 170/172 thereby permitting actuation of the device as previously described above. Upon release of locking member 190, the rear portion of base 152 again returns to a first or locked position where it again limits the outward separation of the finger guides 170/172 relative to each other.

The embodiment as shown in FIGS. 24 through 26 operates identically with those shown in FIGS. 13 through 16 except the locking ledges 174/176 normally engage the rim of mounting cup 13 rather than the top of turret 11. Otherwise the operation of separating the finger guides 170/172 relative to each other to move the locking ledges 174/176 out of operative engagement with the mounting cup 13 to permit vertical movement of the finger rest 178 is identical.

Actuation of the alternate embodiment of FIGS. 5 through 7 is similar. By inserting a finger between the finger guides 46 and 48, the locking ledges 50 and 52 are moved out of operative engagement with the button depressor 40, allowing the depressor 40 to engage the button actuator 34 and actuate the dispenser. Deactivation is similar to the basic embodiment except that as the operator's finger is withdrawn, the locking ledges 50 and 52 engage the button depressor 40 to hold it out of operative engagement from the button actuator 34.

Operation of the alternate embodiment of FIGS. 27 through 30 is similar to that of FIGS. 5 through 7 previously discussed. Specifically, insertion of a finger between finger guides 46/48 and against tab member 204/206 causes finger guides 46/48 to move outwardly relative to the button actuator 200 thereby disengaging locking ledges 212/214 from enlarged locking member 202 permitting vertical movement of the button acutator 200 relative to the dispenser thereby actuating the dispenser. Deactuation is similar to that of the basic embodiment except that as the operator's finger is withdrawn, the locking ledges 212/124 engage enlarged locking member 202 to prevent vertical movement of the button actuator 200 relative to the dispenser.

To operate the alternate embodiment of FIGS. 8 and 9, the operator inserts a finger between finger guides 78 and 80. If the finger is larger than the predetermined size, the finger guides 78 and 80 will flex outwardly away from each other increasing the separator between finger guards 92 and 94 permitting the finger to pass therebetween to operate the button actuator 34. Upon removal of the finger, the finger guards 92, 94 and finger guides 78, 80 will return to the normal position.

As shown in FIG. 10, the lip extension 104 requires that the actuating finger exceeds a predetermined length in order to extend through the finger passage and engage the button actuator.

The operation of the embodiment of FIGS. 11 and 12 is identical to that of FIGS. 1 through 4. Insertion of a finger greater than a predetermined size into the finger passage 19 forces the finger guides 18 and 20 outwardly relative to each other moving the locking ledges 30 and 32 out of operative engagement with the button actuator 34 thereby permitting vertical movement of the button actuator 34 to dispense product from the dispenser. Upon withdrawl of the finger from the finger passage 19, finger guides 18 and 20 and locking ledges 30 and 32 move inwardly to the normally "locked" position.

The embodiment of FIGS. 31 and 32 operates similarly to that of the embodiment shown in FIGS. 20 through 23. Specifically, the alternate embodiment comprises a double lock adaptor 216 wherein the locking lugs 224/226 form a second locking means to prevent the separation of the finger guides when in the "locked" position. To actuate, the finger depressor 228 is pressed forward relative to the alignment slots 230/232 respectively such that the finger guides 170/172 may be separated by insertion of a finger therebetween moving locking ledges 174/176 out of operative engagement with the turret 11. As previously described, finger rest 178 may be depressed to actuate the valve assembly. Upon deactuation the safety adaptor automatically returns to the "locked" position.

Operation of the alternate embodiment of FIGS. 33 and 34 is similar to that of FIGS. 5 through 7 previously discussed. Specifically, insertion of a finger greater than a predetermined size into the finger passage 254 engages the actuator elements 246 and 248 rotating the locking elements 250 and 252 inwardly relative to the body 242 and out of operative engagement with the locking ledge 270. This permits depression of the button depressor 232 downward against the valve actuator 34 to actuate the dispenser. Upon release of the button depressor 232, the button actuator 34 moves upwardly forcing the button depressor 232 returning the locking elements 240 and 242 to the "locked" position.

By this unique combination of structural elements, applicant invented a childproof safety adaptor which provides a maximum of safety. This is accomplished since the adaptor automatically returns to the "locked" position upon deactuation. This configuration is readily adaptable to existing overcaps and aerosol valves.

It will thus be seen that the objects of this invention, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

Now that the invention has been described,

What is claimed is:

1. A safety adaptor for a fluid dispenser comprising a valve actuator means, control means connected to said valve actuator means and configured to prevent actuation of the valve actuator means by a finger less than a predetermined dimension, said control means comprising a pair of finger guides disposed in predetermined spaced apart relation to one another, at least one of said finger guides movable relative to the other and including a locking element mounted thereon and movably connected to the valve actuator means, said locking element movable into and out of locking engagement with the fluid dispenser upon movement of said one movable finger guide relative to the other finger guide and said valve actuator means; said valve actuator means comprising a base disposable in engageable relation with a valve mechanism on said fluid dispenser, said one locking element being coupled to said base by resilient interconnecting means such that said locking element is movable between a locked and actuated position relative to said valve actuator means; each of said finger guides including an actuator element, said actuator elements disposed relative to one another to cooperatively form a finger passage therebetween, each of said actuator elements connected to one locking element; each of said actuator elements and said corresponding locking elements being coupled to each other to cooperatively form said finger guides, each of said locking elements movably connected to opposite sides of said base and disposable into and out of locking engagement with the fluid dispenser upon movement of said actuator elements; each of said resilient interconnecting means being attached to a predeterminded portion of one of said finger guides such that movement of said actuator elements relative to one another causes movement of said locking elements relative to one another into and out of locking engagement with the fluid dispenser; and an overcap, said overcap including a stepped inner skirt, said stepped inner skirt comprising an upper and lower wall section integrally connected to one another, the cross-sectional dimension of said overcap being such that said upper wall is greater than the cross-sectional dimension of said lower wall to cooperatively define a locking ledge therebetween.

2. The safety adaptor of claim 1 wherein said locking elements are disposed on the interior of said overcap structure and positionable into and out of engagement with said locking ledge, upon movement of said actuator elements.

3. The safety adaptor of claim 1 wherein said overcap comprises a substantially cylindrical outer wall and a substantially cylindrical inner skirt coupled together by interconnecting means.

4. The safety adaptor of claim 3 wherein said inner skirt comprises an upper and lower inner wall, the diameter of said lower wall reduced relative to the diameter of said upper wall to cooperatively form said locking ledge therebetween.

5. The safety adaptor of claim 4 wherein said locking ledge comprises a substantially horizontal annular ledge.

* * * * *

UNITED STATES PATENT OFFICE

CERTIFICATE OF CORRECTION

Patent No. 4,017,009 Dated April 12, 1977

Inventor(s) Robert F. Ewald et al.

It is certified that error appears in the above-identified patent and that said Letters Patent are hereby corrected as shown below:

Column 5, llne 56, "168/168" should read --166/168--.

Column 6, line 28, "46 a-c 148 a-c" should read --46 a-c 48 a-c--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*